US008453336B2

(12) United States Patent
LoRocco

(10) Patent No.: US 8,453,336 B2
(45) Date of Patent: Jun. 4, 2013

(54) PEEP SIGHT ASSEMBLY WITH REMOVABLE INSERTS FOR ARCHERY BOWS

(75) Inventor: Paul LoRocco, Dallas, TX (US)

(73) Assignee: TruGlo, Inc., Richardson, TX (US)

( * ) Notice: Subject to any disclaimer, the term of this patent is extended or adjusted under 35 U.S.C. 154(b) by 6 days.

(21) Appl. No.: 13/250,603

(22) Filed: Sep. 30, 2011

(65) Prior Publication Data

US 2013/0081292 A1 Apr. 4, 2013

(51) Int. Cl.
*F41G 1/467* (2006.01)

(52) U.S. Cl.
USPC ..... 33/265; 124/87

(58) Field of Classification Search
USPC ..... 33/265; 124/87, 88, 90
See application file for complete search history.

(56) References Cited

U.S. PATENT DOCUMENTS

| | | | | |
|---|---|---|---|---|
| 3,703,770 | A * | 11/1972 | Sofield | 33/265 |
| 4,656,747 | A | 4/1987 | Troncoso | |
| 5,137,007 | A | 8/1992 | Shoemake et al. | |
| 5,669,146 | A | 9/1997 | Beutler | |
| 5,697,357 | A * | 12/1997 | Chipman | 33/265 |
| 6,282,800 | B1 * | 9/2001 | Beutler | 33/265 |
| 7,040,027 | B1 * | 5/2006 | Shaffer et al. | 33/265 |
| 7,543,389 | B2 * | 6/2009 | Grace, Jr. | 33/265 |
| 7,543,390 | B2 * | 6/2009 | Bach | 33/265 |
| 2003/0019118 | A1 * | 1/2003 | Wilson | 33/265 |
| 2007/0050998 | A1 * | 3/2007 | Myers | 33/265 |
| 2007/0119060 | A1 * | 5/2007 | Grace, Jr. | 33/265 |
| 2008/0066328 | A1 * | 3/2008 | Bohn | 33/265 |
| 2009/0007445 | A1 * | 1/2009 | Bach | 33/265 |
| 2011/0271942 | A1 * | 11/2011 | Buck | 124/87 |

* cited by examiner

*Primary Examiner* — Yaritza Guadalupe-McCall
(74) *Attorney, Agent, or Firm* — Alvin R. Wirthlin

(57) ABSTRACT

A peep sight assembly for an archery bow includes a peep sight housing adapted for connection to a bow string of an archery bow and a plurality of interchangeable peep sight inserts for installation in the peep sight housing. Each peep sight insert has a different aperture size and/or color for accommodating different users and/or shooting conditions. Mutually engageable sloped surfaces on the peep sight housing and the peep sight inserts provide a large contact area for frictionally holding the inserts within the housing. Outer flanges on the peep sight also assist to hold the inserts within the housing.

20 Claims, 7 Drawing Sheets

PEEP SIGHT ASSEMBLY WITH REMOVABLE INSERTS FOR ARCHERY BOWS

BACKGROUND OF THE INVENTION

This invention relates generally to peep sights for archery bows, and more particularly to a peep sight assembly having interchangeable inserts with different aperture sizes for accommodating different users and shooting conditions.

In the field of archery, it is well-known to provide a peep sight on the string above the nocking point of an archery bow. The peep sight must be properly located so that a user may accurately sight in the bow sight with respect to a distant target while in a shooting stance. The particular peep sight position is largely dependent on the archer's anchor point when the bow is fully drawn in relation to his or her aiming eye, which may be different for each archer. Since the bow is custom fit to each archer, there are many variables which affect the sight picture, such as the draw length, the size and location of a front sight aperture with respect to the archer's eye, the shape of the archer's face including the location of the eye with respect to other prominent facial features, as well as an archer's eyesight condition.

Traditional peep sights are usually designed to be as small and light as possible, so when the peep sight is changed for another size, the length of the bow string is also changed because the outside diameter of the peep sight has changed. The larger the peep sight, the shorter the string becomes because the string halves are being pulled further apart. Consequently, the cam timing must be retuned and the nock height must be readjusted for the bow. Such adjustments are very detail oriented and time consuming, requiring skill and special tools that many archers do not have.

In addition, when a peep sight is changed for another peep sight, an inexperienced archer may have difficulty in tying the new peep sight to the bow string since the knot tying process may take time and/or the knots may be improperly formed, which may lead to inadvertent movement of the peep sight, or injury if one or more of the knots were to fail, especially when the bow string is released during shooting.

Accordingly, it would be desirable to provide a peep sight assembly that overcomes at least some of the disadvantages of the prior art.

BRIEF SUMMARY OF THE INVENTION

According to one aspect of the invention, a peep sight assembly for an archery bow includes a peep sight housing adapted for connection to a bow string of the archery bow and a peep sight insert for changing the size of the sight aperture. The peep sight housing has front and rear surfaces with a first inner surface located therebetween to define a sight aperture with a first dimension. The peep sight insert has a rear flange adapted to abut the rear surface, a front flange adapted to abut the front surface, and a continuous side wall extending between the front and rear flanges to define a sight aperture with a second dimension that is smaller than the first dimension.

According to a further aspect of the invention, a peep sight insert for installation into an aperture of a peep sight for reducing an aperture size of the peep sight includes a rear flange, a front flange, and a continuous side wall extending between the rear and front flanges to define a sight aperture. The continuous side wall includes a first outer sloped surface extending inwardly and forwardly from the rear flange; and a second outer sloped surface extending inwardly and rearwardly from the front flange.

According to yet another aspect of the invention, a peep sight kit includes a peep sight housing adapted for connection to a bow string of an archery bow and a plurality of interchangeable peep sight inserts for installation in the peep sight housing. The peep sight housing has rear and front surfaces and a sight aperture located therebetween. A first inner sloped surface extends inwardly and rearwardly from the front surface, and a second inner sloped surface extends inwardly and forwardly from the rear surface. Each peep sight insert has a sight aperture that is different in size than the other sight apertures of the peep sight kit. Each peep sight insert includes a rear flange, a front flange, and a continuous side wall extending between the rear and front flanges to define the sight aperture. The continuous side wall has a first outer sloped surface that extends inwardly and forwardly from the rear flange and is adapted to abut the first inner sloped surface, and a second outer sloped surface that extends inwardly and rearwardly from the front flange and is adapted to abut the second inner sloped surface.

BRIEF DESCRIPTION OF THE DRAWINGS

The foregoing summary as well as the following detailed description of the preferred embodiments of the present invention will be best understood when considered in conjunction with the accompanying drawings, wherein like designations denote like elements throughout the drawings, and wherein.

It is noted that the drawings are intended to depict only typical embodiments of the invention and therefore should not be considered as limiting the scope thereof. It is further noted that the drawings are not necessarily to scale. The invention will now be described in greater detail with reference to the accompanying drawings.

DETAILED DESCRIPTION OF THE INVENTION

Figure 1:
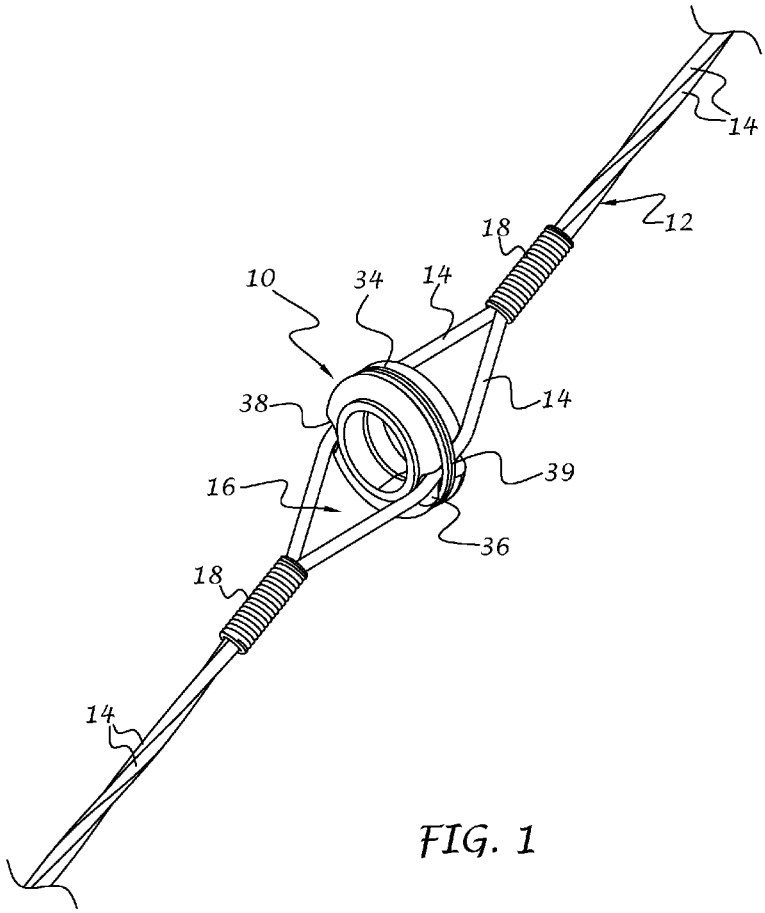
FIG. 1 is an isometric view of a peep sight assembly in accordance with the present invention connected to a bow string.
Figure 2:
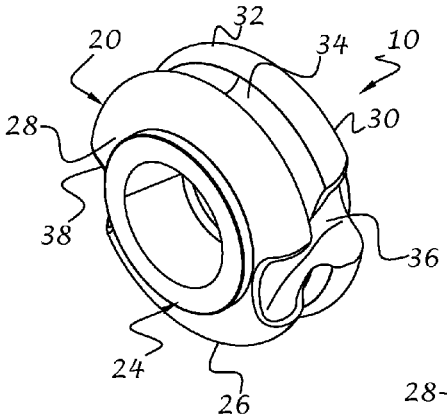
FIG. 2 is an enlarged isometric view of the peep sight assembly.

Referring now to the drawings, and to FIG. 1 in particular, a peep sight assembly 10 in accordance with the present invention is shown connected to a bow string 12 of an archery bow (not shown). The peep sight assembly 10 can be adapted for use with any type of bow including, but not limited to, recurve bows, reflex bows, longbows, compound bows, and so on. The bow string 12 is of conventional construction and typically includes multiple elongate strands 14 of any suitable material used to make bowstrings. A peep sight assembly 10 in accordance with the present invention is shown positioned between the strands 14 in FIG. 1. The strands are sufficiently flexible, at least when the bow string is relaxed or non-stressed, to permit the creation of an opening 16 for receiving the peep sight assembly 10. Sight holders 18 preferably encircle the strands 14 to secure the peep sight to the string 12 in a conventional manner. As shown, the sight holders are in the form of elongate cords that are tied as nail knots around the strands 14 of the string 12. It will be understood that the nail knots may be replaced with individual clamps, slidable crimping members or the like.

Figure 5:
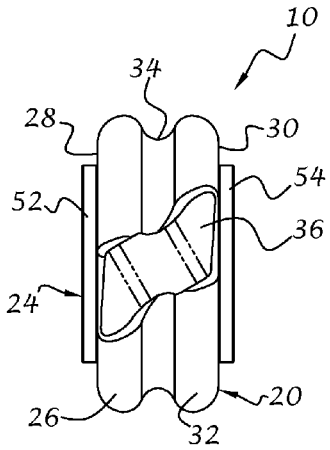
FIG. 5 is a side elevational view thereof.

With additional reference to FIGS. 2-5, the peep sight assembly 10 preferably includes a peep sight housing 20 with a sight aperture 22 and at least one peep sight insert 24 that is removably positioned within the sight aperture. The peep sight housing 20 is preferably constructed of a rigid material, such as aluminum or other metal, plastic and/or ceramic materials, and preferably includes an annular body 26 with a rear face 28, a front face 30, and a continuous side surface 32 extending between the rear and front faces. A groove 34 is formed in the side surface 32. Preferably, the groove 34 extends continuously around the periphery of the annular body 26. Slots 36, 38 are preferably located on opposite sides of the annular body 26. Each slot preferably intersects the circular groove 34 and extends downwardly from the front surface 30 to the rear surface 28 of the annular body 26, as best shown in FIG. 5. Each slot 36, 38 is adapted for receiving the strands 14 of the bow string 12 when the peep sight housing 20 is mounted on the bow string. A cord or band 39 (FIG. 1) can be located in the groove 34 and wraps around the strands 14 in the slots 36, 38 to further secure the peep sight housing 20 to the bow string 12.

Figure 7:
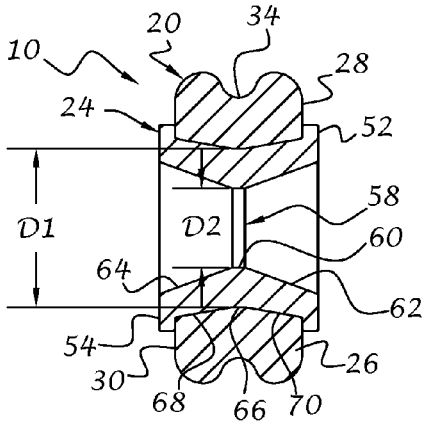
FIG. 7 is a sectional view taken along line 7-7 of FIG. 6.

The sight aperture 22 of the peep sight housing 20 is preferably coaxial with a central axis 40 (FIG. 3) of the annular body 26 and preferably includes a first inner surface 42, a second inner surface 44 that slopes inwardly from the rear face 28 toward the first inner surface 42, and a third inner surface 46 that slopes inwardly from the front face 30 to the first inner surface 42. The first inner surface 42 preferably extends coaxially with the central axis 40 with the second and third inner surfaces sloping away from the first inner surface. The first inner surface 42 forms a sight opening with a predetermined aperture size or diameter D1 (FIG. 7). Preferably, the peep sight housing 20 can be used without the peep sight insert 24 during aiming. Accordingly, the size of the sight aperture 22 is selected to coincide with a largest aperture size that may be needed for most archers and/or archery bow configurations. It will be understood that the first inner surface 46 can be of any width, including zero width which may be in the form of a peak or circular line resulting from the intersection of the second and third inner surfaces.

Figure 6:
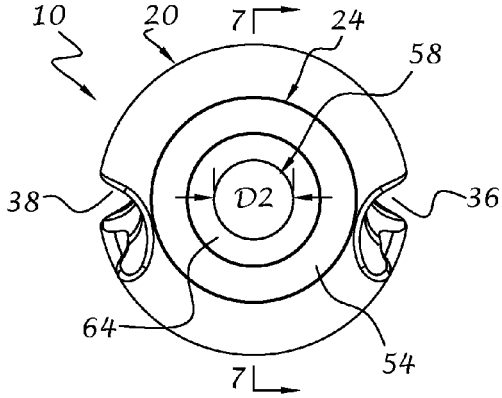
FIG. 6 is a front elevational view of the peep sight assembly with a small aperture insert.

With additional reference to FIGS. 6 and 7, the peep sight insert 24 preferably includes an annular body 50 with a rear flange 52, a front flange 54, and a continuous side wall 56 extending between the rear and front flanges to form a sight aperture 58 that is smaller than the sight aperture 22 previously described. When installed in the peep sight housing 20, the sight aperture 58 is preferably coaxial with the central axis 40 (FIG. 3) of the annular body 26. In this manner, the installation and removal of the peep sight insert does not affect the rear aim point of the bow. The continuous side wall 56 preferably includes a first inner surface 60 (FIG. 7), a second inner surface 62 that slopes inwardly from the rear flange 52 toward the first inner surface 60, and a third inner surface 64 that slopes inwardly from the front flange 54 and the first inner surface 60. The first inner surface 60 preferably extends coaxially with the central axis 40 with the second and third inner surfaces 62, 64 sloping away from the first inner surface. The first inner surface 60 forms a sight opening with a predetermined aperture size or diameter D2 that is smaller than the diameter D1 of the sight aperture 22. It will be understood that the first inner surface 60 can be of any width, including zero width which may be in the form of a peak or circular line resulting from the intersection of the second and third inner surfaces 62, 64.

Figure 3:
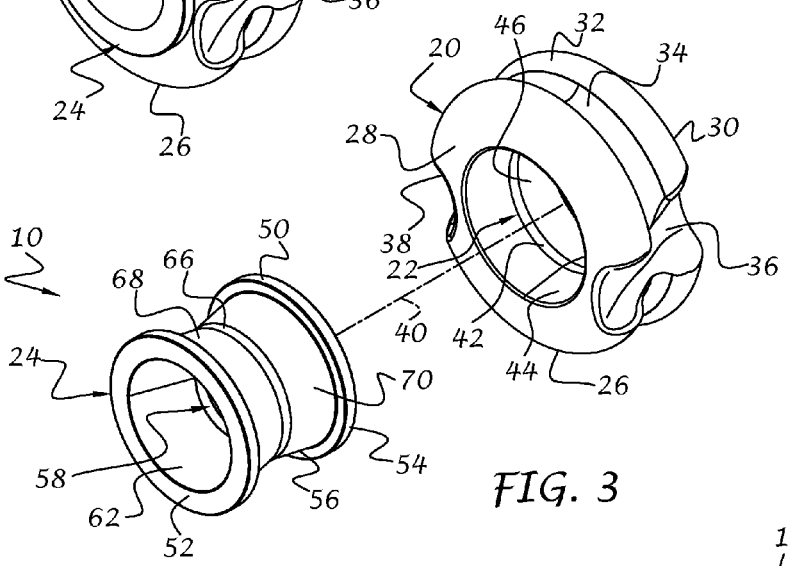
FIG. 3 is an exploded isometric view thereof.
Figure 4:
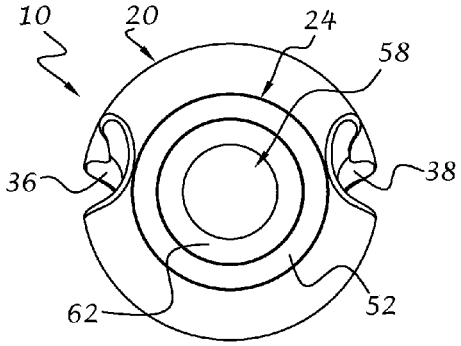
FIG. 4 is a rear elevational view thereof.

As best shown in FIGS. 3 and 7, the continuous side wall 56 also preferably includes a first outer surface 66, a second outer surface 68 that slopes inwardly from the rear flange 52 toward the first outer surface 66, and a third outer surface 70 that slopes inwardly from the front flange 54 and the first outer surface 66. Depending on the size of the sight aperture 22 and the thickness of the continuous side wall 56, the slope of the second and third outer surfaces may be different from the slope of the second and third inner surfaces of the peep sight insert 24. The slope of the second and third outer surfaces preferably corresponds to the slope of the second and third inner surfaces of the peep sight housing.

When the peep sight insert 24 is installed in the peep sight housing 20, the first, second and third outer surfaces of the peep sight insert 24 respectively engage the first, second and third inner surfaces of the peep sight housing 20, with the rear flange 52 and front flange 54 of the peep sight insert 24 respectively abutting the rear surface 26 and front surface 30 of the peep sight housing 20. Preferably, the peep sight insert 24 is constructed as a unitary member during the forming process, and is formed of a resilient material, such as rubber, so that the insert 24 can be easily installed and removed by an archer or other person while in the field or other location without tools. Preferably, the material has a Shore A hardness in the range of about 40 to 100 durometer, and more preferably about 70 durometer. However, it will be understood that other rubber compounds or other types of elastomeric material can be used. In addition, the sloped outer surfaces 68 and 70 increase the surface area over a cylindrical or straight outer surface, providing more gripping area between the sloped surfaces of the peep sight housing 20 and the sloped surfaces of the peep sight insert 24 to thereby more securely anchor the insert to the peep sight housing without the need of tools, clamps, adhesives or other secondary securing means. In addition, the outer sloped surfaces 68, 70 of the peep sight insert 24 are preferably of a uniform matte finish to increase the friction fit between the insert and peep sight housing. Thus, the front and rear flanges together with the sloped surfaces and the surface finish on the outer sloped surfaces 68, 70 of the peep sight insert 24 contribute to firmly anchoring the peep sight insert within the peep sight housing.

In addition, the outer surfaces 66, 68 and 70 are preferably slightly larger than the corresponding inner surfaces 42, 44 and 46 to create an interference fit when the peep sight insert 24 is installed in the peep sight housing 20. In this manner, the increased frictional force due to the increased pressure between the outer sloped surfaces of the peep sight insert and the inner sloped surfaces of the peep sight housing together with the material hardness, inner and outer flanges and material finish contribute to firmly anchoring the insert within the peep sight housing even while subjected to high forces exerted on the peep sight assembly 10 when the bow string is released during shooting, in both dry and wet conditions. In accordance with a preferred embodiment of the invention, the interference fit is in the range of about 0.001 to about 0.020 inch overlap, and more preferably about 0.010 inch. It will be understood that the peep sight insert 24 can greatly vary in sloped surface angle, material type, surface finish, material hardness, and dimensions of the various parts without departing from the spirit and scope of the invention.

Figure 8:
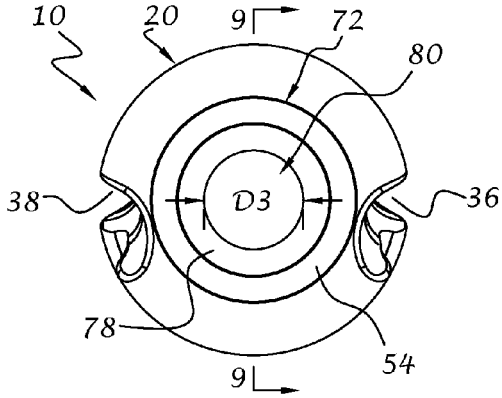
FIG. 8 is a front elevational view of the peep sight assembly with a medium aperture insert.
Figure 9:
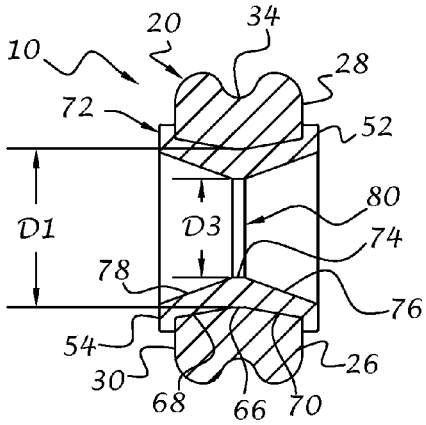
FIG. 9 is a sectional view taken along line 9-9 of FIG. 8.

Referring now to FIGS. 8 and 9, a further peep sight insert 72 in accordance with another aspect of the invention is illustrated. The peep sight insert 72 is similar to the peep sight insert 24 previously described, and fits into the peep sight housing 20 substantially in the same way as the peep sight insert 24, but differs in that the second inner surface 76 and third inner surface 78 slope toward the first inner surface 74 at a different angle than the second and third inner surfaces of the insert 24 to thereby create a sight opening 80 with an aperture size or diameter D3 that is larger than the diameter D2 of the peep sight insert 24.

Figure 10:
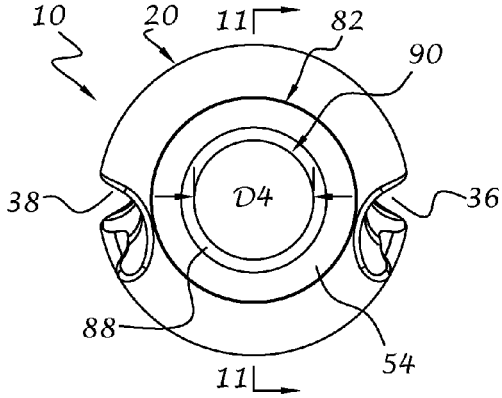
FIG. 10 is a front elevational view of the peep sight assembly with a large aperture insert.
Figure 11:
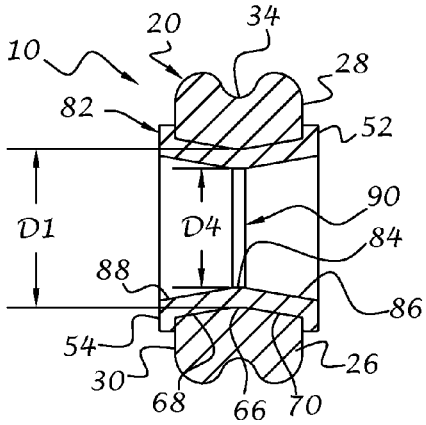
FIG. 11 is a sectional view taken along line 11-11 of FIG. 10.
Figure 12:
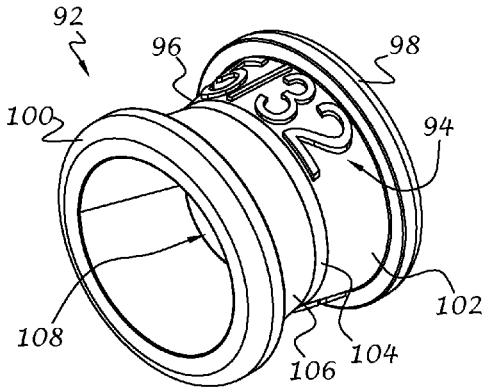
FIG. 12 is an isometric view of a peep sight insert having a particular aperture size in accordance with a further embodiment of the invention.
Figure 13:
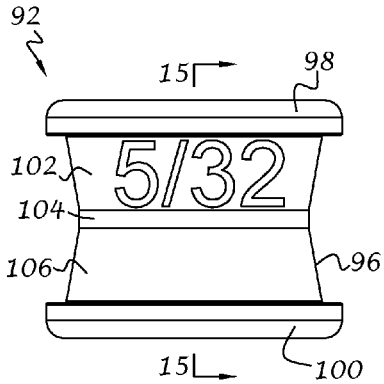
FIG. 13 is a top plan view thereof.

Referring now to FIGS. 10 and 11, a further peep sight insert 82 in accordance with the invention is illustrated. The peep sight insert 82 is similar to the peep sight inserts 24 and 72 previously described, and fits into the peep sight housing 20 substantially in the same way as the peep sight insert 24 and 72, but differs in that the second inner surface 86 and third inner surface 88 slope toward the first inner surface 84 at a different angle than the second and third inner surfaces of the inserts 24 and 72 to thereby create a sight opening 90 with an aperture size or diameter D4 that is larger than the diameter D3 of the insert 24 but smaller than the diameter D1 of the peep sight housing 20.

The provision of a peep sight assembly having interchangeable inserts with different aperture sizes in accordance with the invention accommodates different physical attributes of many users as well as different bow types, shooting styles and conditions without the need to retune the cam timing and nock height of the bow, as well as other adjustments that require skill, attention to detail, and special tools that may not be available or convenient to carry for many archers.

Furthermore, the provision of a peep sight assembly having interchangeable inserts with different aperture sizes allows the user to easily match the peep diameter (which functions as a rear sight) with the archery sight diameter (which functions as a front sight) more closely for a particular setup. The better the rear peep sight co-witnesses with the front archery sight, the tighter the arrow groupings will be. Since the bow is custom fit to each archer, there are many variables which affect the sight picture, such as draw length, the size and location of front sight aperture relative to the archer's eye, the shape of the archer's face including eye location with respect to other prominent facial features, and the archer's eyesight condition. Having an easily removable peep sight insert is ideal because the user can try all the combinations with his or her own eyes without the use of a bow press or professional archery shop. This is especially handy for users with aging eyes, or for archers using a front lens on their sight. By reducing the peep size, the sight picture through the peep sight is greatly clarified.

In addition to providing a different aperture size for each peep sight insert 24, 72 and 82, the inserts may be formed in different colors to indicate size and/or to accommodate the eyesight of different users as well as shooting conditions. By way of example, certain colors for some archers are more noticeable than the same colors for other archers. For example, the color red may be more prevalent, and thus more preferred, for one archer while the color blue may be more prevalent and more preferred for another archer. To that end, the provision of several visually distinct peep sight inserts facilitates the user's ability to readily locate the peep sight, especially when time is of the essence, such as during aiming at a momentary target. Furthermore, providing different inserts with colors or other visual effects for enhancing the peep sight during different ambient light conditions, such as full sun and low light conditions, is also contemplated.

Figure 14:
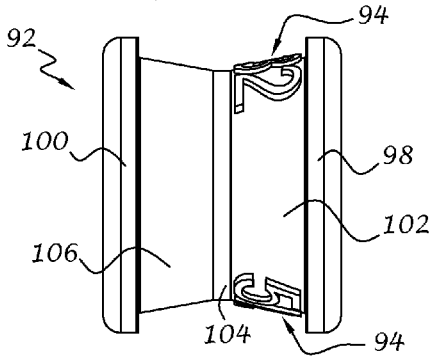
FIG. 14 is a side elevational view thereof.
Figure 15:
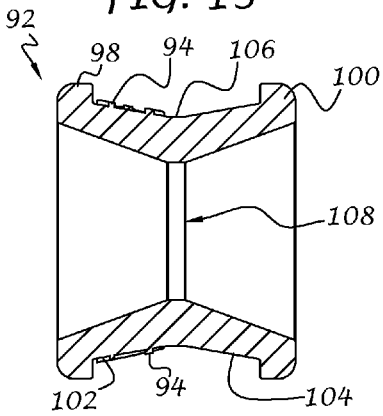
FIG. 15 is a sectional view of the peep sight insert taken along line 15-15 of FIG. 13.

Referring now to FIGS. 12-15, a peep sight insert 92 in accordance with a further embodiment of the invention is illustrated. This peep sight insert 92 is similar to the peep sight inserts 24, 72 and 82 previously described, and fits into the peep sight housing 20 substantially in the same way as the peep sight insert 24 and 72, but differs in that one or more labels 94 representing an aperture size or diameter of the insert 92 is formed on the continuous side wall 96 between the front flange 98 and the rear flange 100. As shown in FIG. 14, the label 94 is preferably integrally formed on diametrically opposite sides of the third outer surface 102. However, it will be understood that the label 94 can be formed on the second outer surface 106 or at other locations on the peep sight insert 92. As shown, the labels 94 extend radially outwardly from the third outer surface 102 to form raised indicia indicating the size of the aperture. By way of example, for an aperture 108 having a 5⁄32 inch opening, the raised indicia "5⁄32" is formed on diametrically opposite sides of the surface 102 to thereby efficiently inform a user of the aperture size. It will be understood that the fractional indicia can be replaced with and/or supplemented by a decimal equivalent, letter code or other symbols, characters and/or numerals representing the aperture size.

The label 94 in the form of raised indicia also serves to hold the peep sight insert 92 in place within the peep sight housing 20 in a frictional interference fit since the label 94 will become somewhat compressed when the peep sight insert 92 is installed in the peep sight housing 20. It will be further understood that the label 94 can be imprinted into the insert 92 to form sunken indicia rather than the raised indicia without departing from the spirit and scope of the invention.

Figure 16:
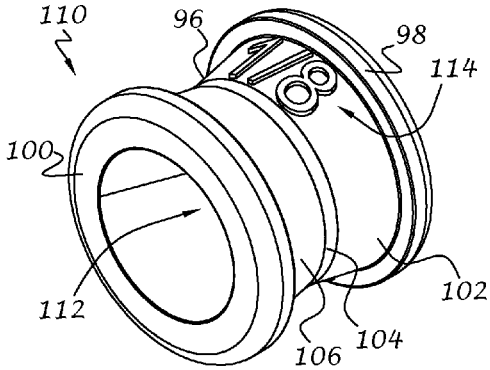
FIG. 16 is an isometric view of a peep sight insert having a different aperture size in accordance with the invention.
Figure 17:
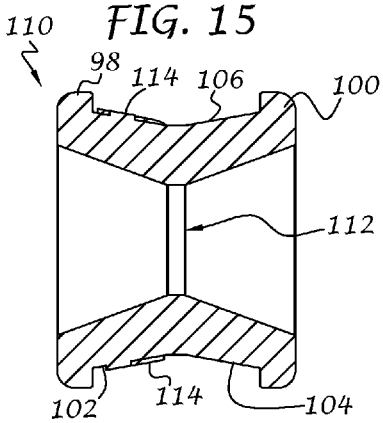
FIG. 17 is a sectional view of the insert of FIG. 16.

Referring now to FIGS. 16 and 17, a peep sight insert 110 in accordance with a further embodiment of the invention is illustrated. The peep sight insert 110 is similar to the peep sight insert 92 previously described, but differs in that the sight aperture 112 is of a different size than the sight aperture 108. Accordingly, one or more labels 114 representing the aperture size or diameter of the insert 110 is formed on the continuous side wall 96 as in the previous embodiment. For an aperture 112 having a ⅛ inch opening for example, the raised indicia "⅛" is formed on diametrically opposite sides of the surface 102 to thereby efficiently inform a user of the aperture size.

Figure 18:
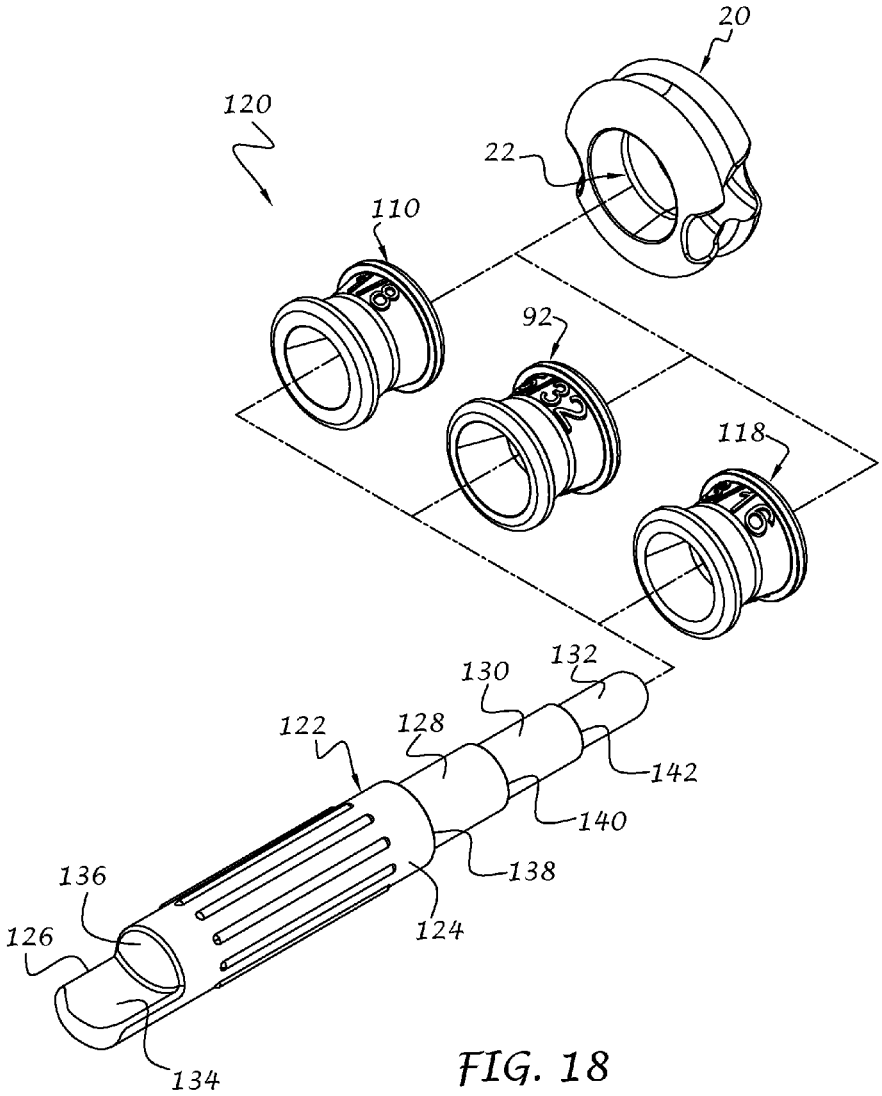
FIG. 18 is an isometric view of a peep sight kit having a peep sight and a number of differently configured peep sight inserts.

Referring now to FIG. 18, the peep sight assembly can be provided in the form of a kit 120 with a peep sight housing 20 having a first aperture size 22 and a plurality of peep sight inserts 92, 110 and 118, for example, with different aperture sizes. By way of example, the aperture size of the peep sight housing 20 is ¼ inch, while the aperture sizes of the peep sight inserts 110, 92 and 118 are respectively ⅛ inch, 5⁄32 inch and 3⁄16 inch. When a particular aperture size is desired, the peep sight housing 20 may be used alone or with any of the inserts. In this manner, the aperture size can be quickly and conveniently changed without the need of removing the peep sight from the bowstring and the necessary procedures to install another peep sight as previously described. It will be understood that the particular aperture sizes as shown and described are by way of example only and can greatly vary without departing from the spirit and scope of the invention.

The peep sight kit 120 of the present invention allows the user to custom select a color and/or aperture size for the rear sight of an archery bow configuration. Since the peep insert is easily changed, the user can try different colors to best suit his or her eyesight condition, since lighter colors tend to pass more light than darker colors. In addition, the archer can simply color coordinate the peep insert with other bow accessories.

Another advantage of this invention is to allow the user the option to quickly remove the peep sight insert during low light conditions, which is ideal for hunting since larger peep diameters will allow more light to pass through, improving the sight picture. The point of impact on a distal target will not change when the peep sight insert is replaced because the insert is always centered in the peep sight housing. Accordingly, the archer can shoot with confidence either with or without the peep sight insert.

A tool 122 can also be provided as part of the kit 120 for facilitating the installation and removal of the peep sight inserts. As shown, the tool 122 preferably has a generally cylindrical shape and includes a handle section 124, a wedge section 126 extending rearwardly from the handle section, and drive sections 128, 130 and 132 extending forwardly from the handle section. The wedge section 126 includes a curved contact surface 134 extending in an axial direction and a wall 136 extending in a radial direction from the contact surface. The curved contact surface preferably has a shape that complements the shape of the front and rear flanges of the peep sight inserts 110, 92 and 118. The handle and drive section 128 are preferably separated by a step 138. Likewise, the drive sections 130 and 132 are separated by steps 140 and 142, respectively. The diameters of the drive sections 128, 130 and 132 preferably correspond to the aperture sizes of the peep sight inserts 118, 92 and 110, respectively.

Figure 19:
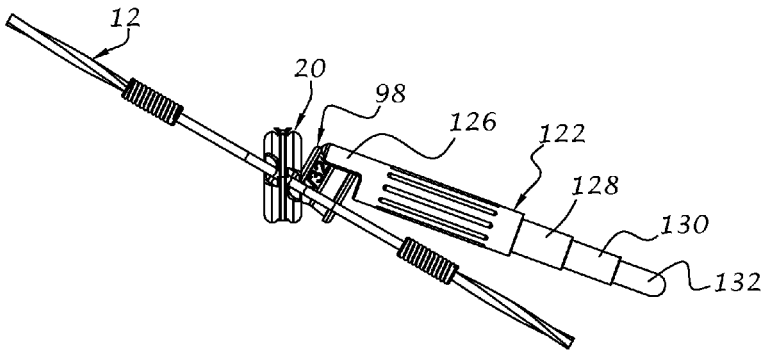
FIGS. 19-21 show the steps, in a side elevational view, for installing a peep sight insert into a peep sight housing mounted on a bow string.
Figure 20:
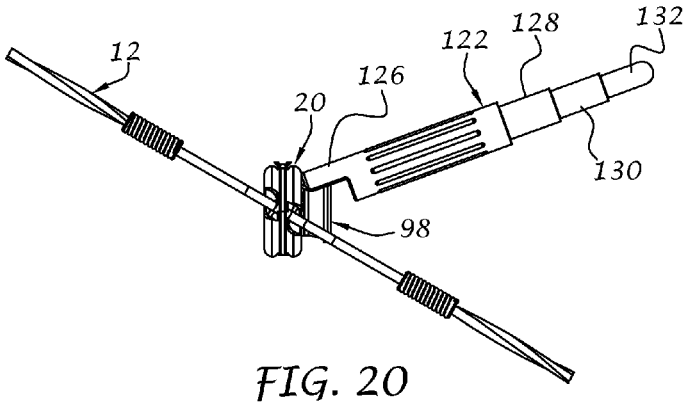
Figure 21:
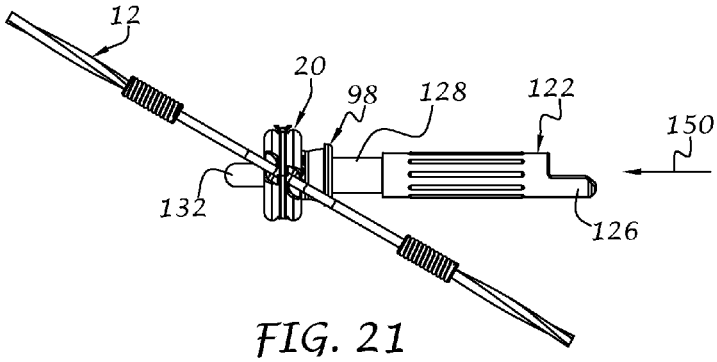

Turning now to FIGS. 19-21, a method of installing a peep sight insert into a peep sight housing the tool 122 is illustrated. Although the method will be described using the peep sight insert 92, it will be understood that it applies to all inserts. As shown in FIG. 19, the insert 92 is first positioned in the aperture of the peep sight housing 20 at an angle such that the front flange 98 is partially inserted into the aperture opening 22 (FIG. 2) using the wedge section 126 of the tool 122. Once the entire front flange 98 of the insert 92 is inserted into the aperture opening 22 as shown in FIG. 20, the tool 122 is reversed and the appropriate drive section (in this case drive section 130) corresponding to the size of the insert aperture (in this case aperture 108 in FIG. 15), is inserted into the aperture, as shown in FIG. 21. The tool is then pushed forward as shown by arrow 150 until the front flange 98 and rear flange 100 are seated against the peep sight housing 20. Although this method has been shown installing the insert in the forward direction from the rear of the peep sight housing 20, the insert can alternatively be installed in the rearward direction from the front of the peep sight housing.

Figure 22:
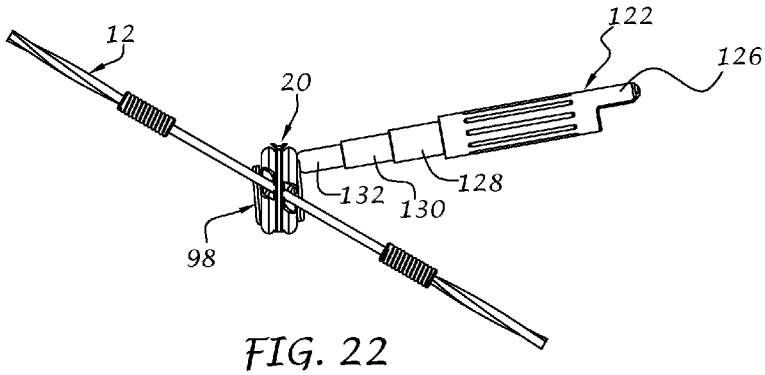
FIGS. 22-24 show the steps, in a side elevational view, for removing a peep sight insert from a peep sight housing mounted on a bow string.
Figure 23:
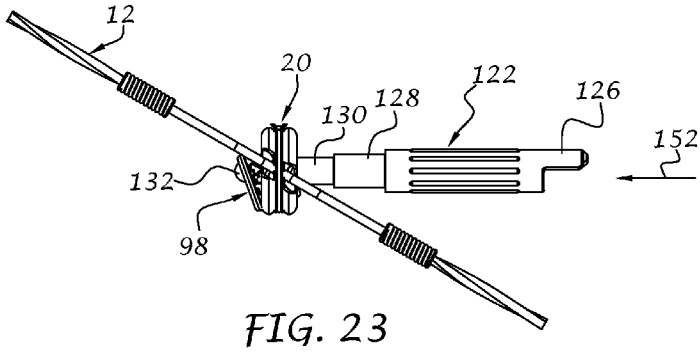
Figure 24:
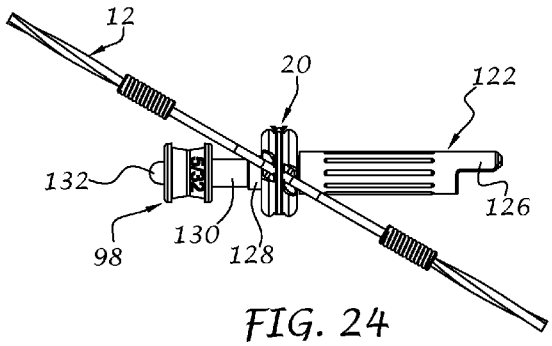

Referring now to FIGS. 22-24, a method of removing a peep sight insert from a peep sight housing the tool 122 is illustrated. Although the method will be described using the peep sight insert 92, it will be understood that it applies to all inserts. As shown in FIG. 22, the drive end of the tool 122 is positioned between the peep sight housing 20 and the rear flange 100 of the insert 92. This can also be accomplished with the wedge section 126 of the tool. The tool is then pushed down and through the insert aperture 108 (FIG. 15) with the appropriate drive section 130, as shown in FIG. 23. The tool is then pushed forward, as represented by arrow 152 in FIG. 23, until the insert 92 is removed from the peep sight housing 20, as shown in FIG. 24. Although this method has been shown removing the insert in the forward direction from the rear of the peep sight housing 20, the insert can alternatively be removed in the rearward direction from the front of the peep sight housing.

It will be understood that the term "preferably" as used throughout the specification refers to one or more exemplary embodiments of the invention and therefore is not to be interpreted in any limiting sense. In addition, terms of orientation and/or position as may be used throughout the specification denote relative, rather than absolute orientations and/or positions.

It will be appreciated by those skilled in the art that changes could be made to the embodiments described above without departing from the broad inventive concept thereof. For example, although the peep sight housing, peep sight inserts and their corresponding apertures have been shown as circular in shape, it will be understood that such components can be of other shapes without departing from the spirit and scope of the invention. It will be understood, therefore, that the present invention is not limited to the particular embodiments disclosed, but also covers modifications within the spirit and scope of the invention as defined by the appended claims.

What is claimed is:

1. A peep sight assembly for an archery bow, the peep sight assembly comprising:

a peep sight housing capable of connection to a bow string of the archery bow, the peep sight housing having front and rear surfaces with a first inner surface located therebetween to define a sight aperture with a first dimension; and a peep sight insert capable of axial installation in the peep sight housing and having a rear flange for abutting the rear surface, a front flange for abutting the front surface, and a continuous side wall extending between the front and rear flanges to define a sight aperture with a second dimension smaller than the first dimension, the continuous side wall being sized to fit within the sight aperture of the peep sight housing.

2. A peep sight according to claim 1, wherein the peep sight housing further comprises:

a second inner surface sloping outwardly and rearwardly from the first inner surface toward a rear surface; and a third inner surface sloping outwardly and forwardly from the first inner surface toward a front surface.

3. A peep sight assembly for an archery bow, the peep sight assembly comprising:

a peep sight housing adapted for connection to a bow string of the archery bow, the peep sight housing having:

front and rear surfaces with a first inner surface located therebetween to define a sight aperture with a first dimension;

a second inner surface sloping outwardly and rearwardly from the first inner surface toward a rear surface; and a third inner surface sloping outwardly and forwardly from the first inner surface toward a front surface; and a peep sight insert adapted for installation in the peep sight housing and having a rear flange adapted to abut the rear surface, a front flange adapted to abut the front surface, and a continuous side wall extending between the front and rear flanges to define a sight aperture with a second dimension smaller than the first dimension, the continuous side wall being adapted to fit within the sight aperture of the peep sight housing; wherein the continuous side wall comprises:

a first outer surface adapted to abut the first inner surface;

a second outer surface sloping outwardly from the first outer surface toward the rear flange and adapted to abut the second inner surface; and a third outer surface sloping outwardly from the first outer surface toward the front flange and adapted to abut the third inner surface.

4. A peep sight assembly according to claim 3, wherein the continuous side wall of the peep sight insert further comprises:

a first inner surface defining the sight aperture;

a second inner surface sloping outwardly from the first inner surface toward the rear flange; and a third inner surface sloping outwardly from the first inner surface toward the front flange.

5. A peep sight assembly according to claim 4, wherein a slope of the second and third outer surfaces of the peep sight insert is different from a slope of the second and third inner surfaces thereof.

6. A peep sight assembly according to claim 3, wherein an outer dimension of the continuous side wall is greater than an inner dimension of the peep sight housing to cause an interference fit between the peep sight housing and the peep sight insert, thereby more securely holding the peep sight insert within the peep sight housing.

7. A peep sight assembly according to claim 6, wherein the peep sight insert is constructed of a flexible silicon rubber material having a Shore A hardness in the range of about 40 to 100 durometer.

8. A peep sight assembly according to claim 7, wherein the peep sight insert has a Shore A hardness of about 70 durometer.

9. A peep sight assembly according to claim 3, and further comprising raised indicia on the continuous side wall to indicate an aperture size and to create an interference fit between the peep sight housing and the peep sight insert to thereby more securely hold the peep sight insert in the peep sight housing.

10. A peep sight insert for installation into an aperture of a peep sight for reducing an aperture size of the peep sight, the peep sight insert comprising:

a rear flange;

a front flange;

a continuous side wall extending between the rear and front flanges to define a sight aperture, the continuous side wall comprising:

a first outer sloped surface extending inwardly and forwardly from the rear flange; and a second outer sloped surface extending inwardly and rearwardly from the front flange, the first and second outer sloped surfaces being capable of contacting corresponding surfaces of the peep sight aperture for providing an enlarged contact area for frictionally holding the inserts within the housing.

11. A peep sight insert according to claim 10, wherein the continuous side wall of the peep sight insert further comprises:

a first inner sloped surface extending inwardly and forwardly from the rear flange; and a second inner sloped surface extending inwardly and rearwardly from the front flange.

12. A peep sight insert according to claim 11, wherein a slope of the first and second outer surfaces is different from a slope of the first and second inner surfaces.

13. A peep sight insert according to claim 10, and further comprising raised indicia on the continuous side wall to indicate a size of the aperture.

14. A peep sight assembly incorporating the peep sight insert of claim 10, and further comprising:

a peep sight housing adapted for connection to a bow string of an archery bow, the peep sight housing having rear and front surfaces and a sight aperture located therebetween, a first inner sloped surface extending inwardly and rearwardly from the front surface, and a second inner sloped surface extending inwardly and forwardly from the rear surface;

wherein the first and second outer sloped surfaces of the peep sight insert are capable of abutting the first and second inner sloped surfaces, respectively, of the peep sight housing when the insert is installed in the housing.

15. A peep sight assembly according to claim 14, wherein the front and rear flanges of the peep sight insert are capable of abutting the front and rear surfaces, respectively, of the peep sight housing when the insert is installed in the housing.

16. A peep sight kit comprising:

a peep sight housing adapted for connection to a bow string of an archery bow, the peep sight housing having rear and front surfaces and a sight aperture located therebetween, a first inner sloped surface extending inwardly and rearwardly from the front surface, and a second inner sloped surface extending inwardly and forwardly from the rear surface; and a plurality of interchangeable peep sight inserts for installation in the peep sight housing, each peep sight insert having a sight aperture that is different in size than the other sight apertures, each peep sight insert comprising:

a rear flange;

a front flange; and a continuous side wall extending between the rear and front flanges to define the sight aperture, the continuous side wall comprising:

a first outer sloped surface extending inwardly and forwardly from the rear flange and adapted to abut the first inner sloped surface; and a second outer sloped surface extending inwardly and rearwardly from the front flange and adapted to abut the second inner sloped surface.

17. A peep sight kit according to claim 16, wherein the front and rear flanges of the peep sight insert are adapted to abut the front and rear surfaces, respectively, of the peep sight housing when the insert is installed in the housing.

18. A peep sight kit according to claim 16, wherein an outer dimension of the continuous side wall is greater than an inner dimension of the peep sight housing to cause an interference fit between the peep sight housing and the peep sight insert, thereby more securely holding the peep sight insert within the peep sight housing.

19. A peep sight kit according to claim 16, and further comprising raised indicia on the continuous side wall to indicate an aperture size and to create an interference fit between the peep sight housing and the peep sight insert to thereby more securely hold the peep sight insert in the peep sight housing.

20. A peep sight kit according to claim 16, and further comprising a tool for installing and removing a peep sight insert, the tool having a handle with a wedge portion at one end thereof and a driving portion at another end thereof, the driving portion having sections equal in size and number to the size and number of the plurality of peep sight inserts.

* * * * *

UNITED STATES PATENT AND TRADEMARK OFFICE

CERTIFICATE OF CORRECTION

PATENT NO. : 8,453,336 B2
APPLICATION NO. : 13/250603
DATED : June 4, 2013
INVENTOR(S) : Paul LoRocco It is certified that error appears in the above-identified patent and that said Letters Patent is hereby corrected as shown below:

On the title page item 75 should read

Inventors: Paul LoRocco, Dallas, TX (US)
John Estridge, Plano, TX (US)
Damon Coalson, Dallas, TX (US)

Signed and Sealed this
Twenty-fourth Day of February, 2015

Michelle K. Lee

Michelle K. Lee
*Deputy Director of the United States Patent and Trademark Office*